US010233065B2

(12) United States Patent
Jackson

(10) Patent No.: US 10,233,065 B2
(45) Date of Patent: Mar. 19, 2019

(54) METHOD AND APPARATUS FOR MAINTAINING THE INTERIOR OF A VERTICAL STRUCTURE

(71) Applicant: Randy Jackson, Manchester, MI (US)

(72) Inventor: Randy Jackson, Manchester, MI (US)

( * ) Notice: Subject to any disclaimer, the term of this patent is extended or adjusted under 35 U.S.C. 154(b) by 91 days.

(21) Appl. No.: 14/691,648

(22) Filed: Apr. 21, 2015

(65) Prior Publication Data

US 2015/0298948 A1 Oct. 22, 2015

Related U.S. Application Data

(60) Provisional application No. 61/981,897, filed on Apr. 21, 2014.

(51) Int. Cl.
*B66F 11/04* (2006.01)

(52) U.S. Cl.
CPC ..... *B66F 11/046* (2013.01)

(58) Field of Classification Search
CPC ..... B66F 7/60; E06C 1/12; E06C 1/39; E06C 5/04; E06C 7/12
See application file for complete search history.

(56) References Cited

U.S. PATENT DOCUMENTS 197,324 A * 11/1877 Boynton ..... E06C 5/04 182/66.1
2,238,665 A * 4/1941 Troche ..... E06C 5/04 182/116
2,726,866 A * 12/1955 Duke ..... A63C 19/005 472/93
3,436,120 A * 4/1969 Armstrong ..... E04G 3/24 299/70
3,664,458 A * 5/1972 Sterns ..... E06C 1/39 182/102
4,094,381 A * 6/1978 Wilkerson ..... E06C 5/04 182/208
4,366,591 A * 1/1983 Zimmerman ..... B63B 27/14 14/71.3
4,688,773 A * 8/1987 Legille ..... F27D 1/1621 266/281
5,018,923 A * 5/1991 Melan ..... E04G 21/22 182/128
5,419,669 A * 5/1995 Kremer ..... F27D 1/1621 266/281
5,738,185 A * 4/1998 Sears ..... E06C 7/12 182/102

(Continued)

FOREIGN PATENT DOCUMENTS

DE 102010063829 A1 * 2/2012 ..... C21C 5/441
DE 102010063829 A1 * 2/2012 ..... C21C 5/441

(Continued)

OTHER PUBLICATIONS

English translation DE10201010063829 https://worldwide.espacenet.com/publicationDetails/citingDocuments?CC=DE&NR=102010063829A1&KC=A1&FT=D&ND=3&date=20120202&DB=EPODOC&locale=en_ep (Year: 2018).*

*Primary Examiner* — Alvin C Chin-Shue
*Assistant Examiner* — Candace L Bradford
(74) *Attorney, Agent, or Firm* — John G. Posa; Belzer PC

(57) ABSTRACT

The present invention relates to an apparatus and a method to repair the interior of a vertical structure. The invention includes a telescopic ladder and a knockdown platform that can be deployed and assembled on-site.

8 Claims, 11 Drawing Sheets

(56) References Cited

U.S. PATENT DOCUMENTS

| | | | | | |
|---|---|---|---|---|---|
| 5,853,066 | A * | 12/1998 | Gohn | A01M 31/02 | 182/20 |
| 6,405,831 | B1 * | 6/2002 | Daniel, III | B66F 11/044 | 182/115 |
| 6,505,707 | B1 * | 1/2003 | Berry | A01M 31/025 | 182/116 |
| 6,511,266 | B1 * | 1/2003 | Groot | B23B 41/00 | 408/1 R |
| 6,640,928 | B1 * | 11/2003 | Ridley, Jr. | E04G 1/30 | 182/208 |
| 7,624,844 | B2 * | 12/2009 | Alexander | E06C 7/02 | 182/127 |
| 8,671,963 | B2 * | 3/2014 | Shih | E04H 15/60 | 135/137 |
| 8,746,403 | B1 * | 6/2014 | Tyner | E06C 1/30 | 182/106 |
| 2006/0076189 | A1 * | 4/2006 | Ziaylek | B60R 9/0423 | 182/127 |
| 2006/0169536 | A1 | 8/2006 | Davis | | |
| 2008/0302605 | A1 * | 12/2008 | St-Germain | E04G 1/20 | 182/223 |
| 2011/0266402 | A1 | 11/2011 | Parrish | | |
| 2012/0160530 | A1 * | 6/2012 | Ikuta | B25F 5/001 | 173/13 |
| 2013/0068559 | A1 * | 3/2013 | Grado | E06C 7/16 | 182/102 |
| 2013/0240687 | A1 | 9/2013 | Mosier | | |
| 2015/0086286 | A1 * | 3/2015 | Ekchian | B23B 31/1207 | 408/124 |
| 2015/0292263 | A1 * | 10/2015 | Hierl | F03D 11/04 | 182/128 |

FOREIGN PATENT DOCUMENTS

| | | | | |
|---|---|---|---|---|
| DE | 102012109860 | A1 * | 4/2014 | E04G 5/007 |
| DE | 102012109860 | A1 * | 4/2014 | E04G 5/007 |
| EP | 2439504 | A2 * | 4/2012 | G01G 19/083 |
| FR | 591169 | A * | 6/1925 | E06C 1/12 |
| FR | 591169 | A * | 6/1925 | E06C 1/12 |
| FR | 2796414 | A3 * | 1/2001 | E04G 1/30 |
| FR | 2796414 | A3 * | 1/2001 | E04G 1/30 |
| GB | 615789 | A * | 1/1949 | B66B 9/16 |
| GB | 615789 | A * | 1/1949 | B66B 9/16 |
| GB | 2521920 | * | 7/2014 | E06C 7/082 |
| WO | WO 201410813 | A1 * | 7/2014 | E06C 7/082 |
| WO | WO 2014108134 | A1 * | 7/2014 | E06C 7/082 |
| WO | WO-2014108134 | A1 * | 7/2014 | E06C 7/082 |

* cited by examiner

METHOD AND APPARATUS FOR MAINTAINING THE INTERIOR OF A VERTICAL STRUCTURE

REFERENCE TO RELATED APPLICATION

This application claims priority to U.S. Provisional Patent Application Ser. No. 61/981,897, filed Apr. 21, 2014, the entire content of which is incorporated herein by reference.

FIELD OF THE INVENTION

The present invention relates to telescopic ladder carried by a vehicle. More specifically, it refers to apparatus including a telescopic ladder and knockdown platform that can be deployed and assembled on-site for repairing a vertical structure.

BACKGROUND OF THE INVENTION

There are many ladder lift systems and methods of use. These generally help an operator to reach at a certain height above the ground. U.S. Pat. No. 7,624,844 Alexander discloses a ladder lift system and method of use that includes a specially designed clamp element which is connected between an extension ladder and a pivotable lift rail. The system includes lower ladder support. The system is especially adapted for use in combination with the bed of a transport or pick-up truck. The system and method of use allows a single workman to safely and easily utilize an extension ladder for a wide variety of work and service tasks. However, none of the prior art addresses the problems related to the maintenance of the vertical structures, such as silos, wherein such work is complicated by the fact that the access doors from below are quite small, in some cases on the order of 36 inches in diameter. Metal vertical structures or silos are used for various purposes including the storage of asphalt and other products. On occasion, repairs, including welding repairs, need to be done on the inside of these structures. As such, maintenance personnel must carry ladders and other equipment through the access port, after which it must be set up for use at different height levels, which is a very time-consuming process.

SUMMARY OF THE INVENTION

The present invention recognizes and addresses disadvantages of the prior art constructions and methods. According to one embodiment, the present invention provides an apparatus to maintain a vertical structure such as a silo. The vertical structure has a bottom opening with a maximum bottom width. The apparatus comprises of a telescopic ladder carried by a vehicle. The ladder has a top end and a bottom end. The apparatus further comprises of a knockdown platform adapted to be assembled inside the vertical structure, the platform being removably attachable to the ladder.

The fully assembled platform has a platform opening enabling an individual to climb through the platform. The apparatus also has a knockdown hoist adapted to be removably attached near the top end of the ladder, which enables equipment and supplies to be brought up through the platform opening to an individual positioned on the platform. The fully assembled platform has a maximum platform width and the maximum platform width is greater than the maximum bottom width. The bottom opening is above the ground.

The knockdown platform at least includes the following components: a frame forming the platform opening; a plurality of ribs attachable and extendable outwardly from the frame; and a plurality of panels covering the ribs. The apparatus may have the ribs that are radially extendable. The apparatus may have a hand held control device, the device being connected by a wire or by a wireless connection to the hoist. The apparatus may have a ladder that is operated by the hydraulic equipment.

The present invention also provides a method to maintain a vertical structure. This method comprises of the following steps: providing the apparatus as discussed above; bringing the ladder into a space under the vertical structure; coordinating a position of the ladder relative to a bottom opening of the vertical structure; aligning the ladder in an upright position under the bottom opening; extending the ladder inside the bottom opening; attaching and using the knockdown hoist to bring equipment and supplies to an individual positioned inside the vertical structure; hoisting parts of the knockdown platform inside the vertical structure using the hoist and assembling the platform inside the vertical structure; and completing steps associated with maintaining the vertical structure. This method may be used to perform the associated steps for maintaining the vertical structure that may include welding, repairing, cleaning, painting, restoration, refurbishment, remodeling, or renovating.

DETAILED DESCRIPTION OF THE INVENTION

Figure 1:
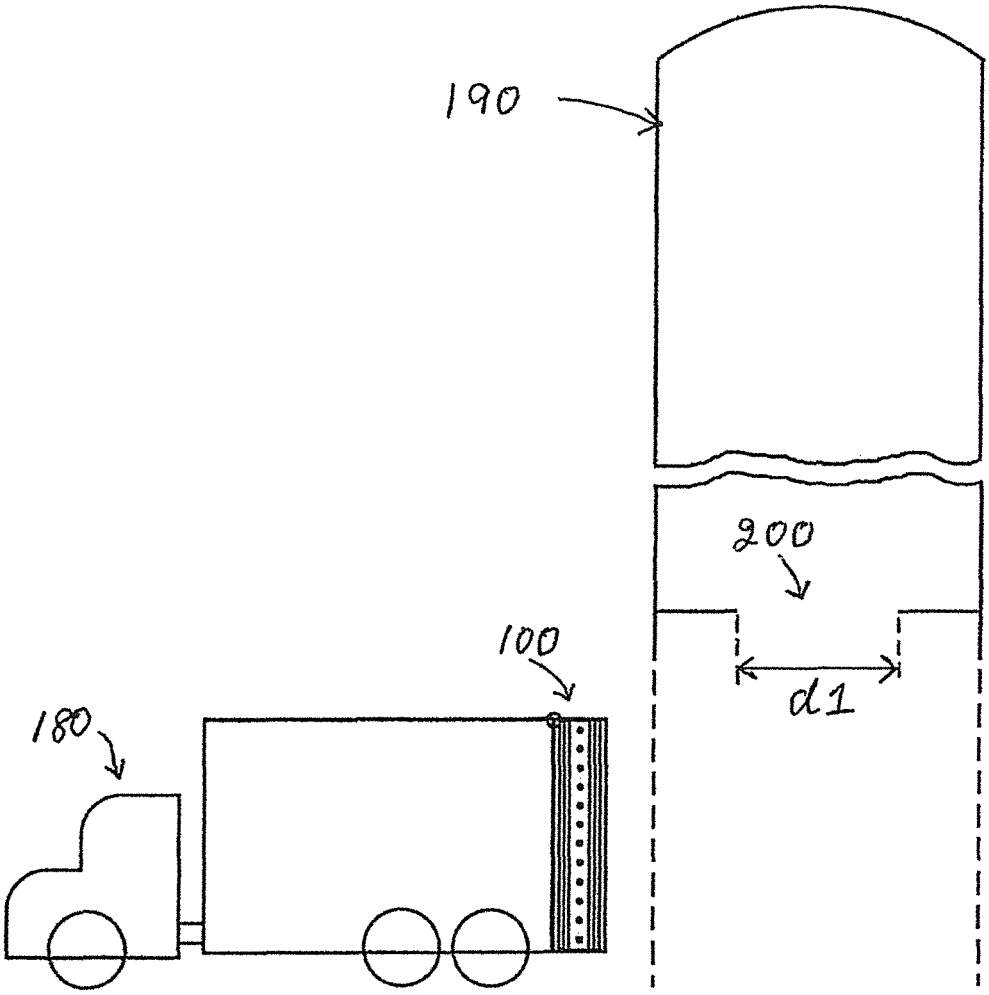
FIG. 1 is a drawing that shows a telescopic ladder carried by a vehicle near a vertical structure.
Figure 2:
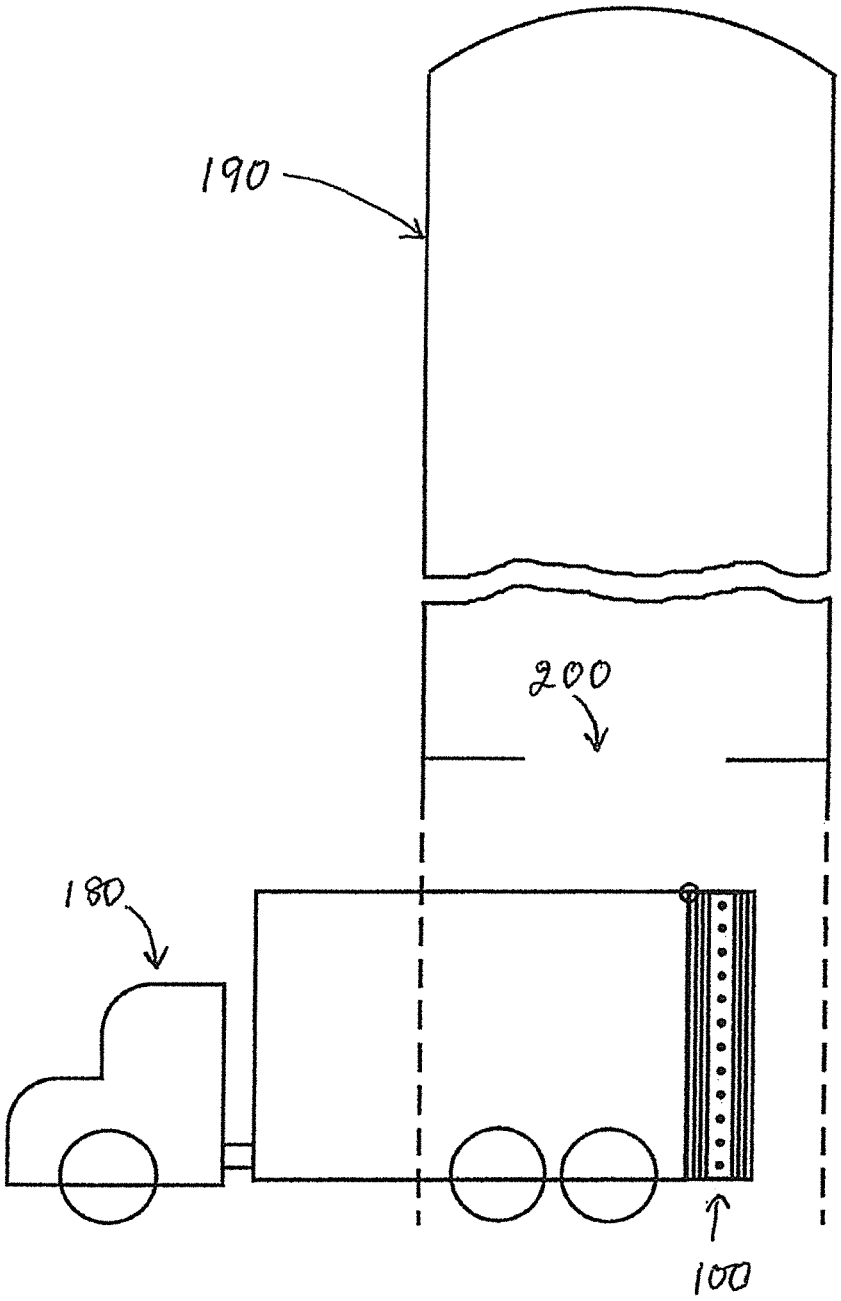
FIG. 2 is a drawing that shows a vehicle and telescopic ladder under a vertical structure.

This invention simplifies the process of maintaining or providing repairs to the interior of the vertical structures such as silos by using equipment including a telescoping ladder and knockdown platform that can be deployed and assembled on-site with much faster turnaround. FIG. 1 shows a vertical structure 190 and an apparatus comprising of a ladder 100 carried by a vehicle 180. The vertical structure has a bottom opening 200 and the bottom opening 200 being generally above the ground. The bottom opening 200 has a maximum bottom width d1. FIG. 2 shows that the ladder 100 may be positioned under the bottom opening 200 of the vertical structure 190. The vehicle 180 may be used for transportation and making position adjustments of the ladder 100.

Figure 3:
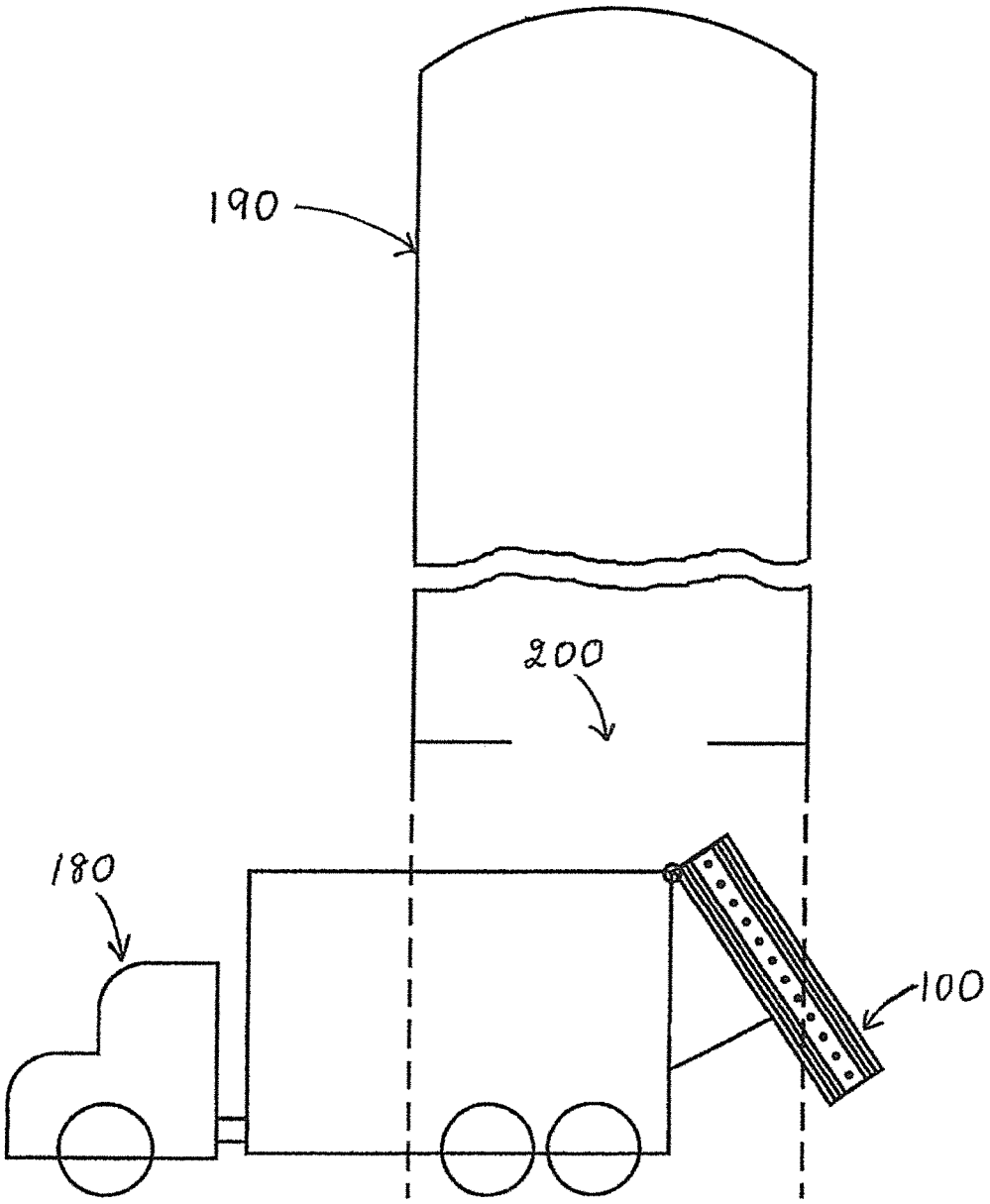
FIG. 3 is a drawing that shows a telescopic ladder being positioned under a vertical structure.
Figure 4:
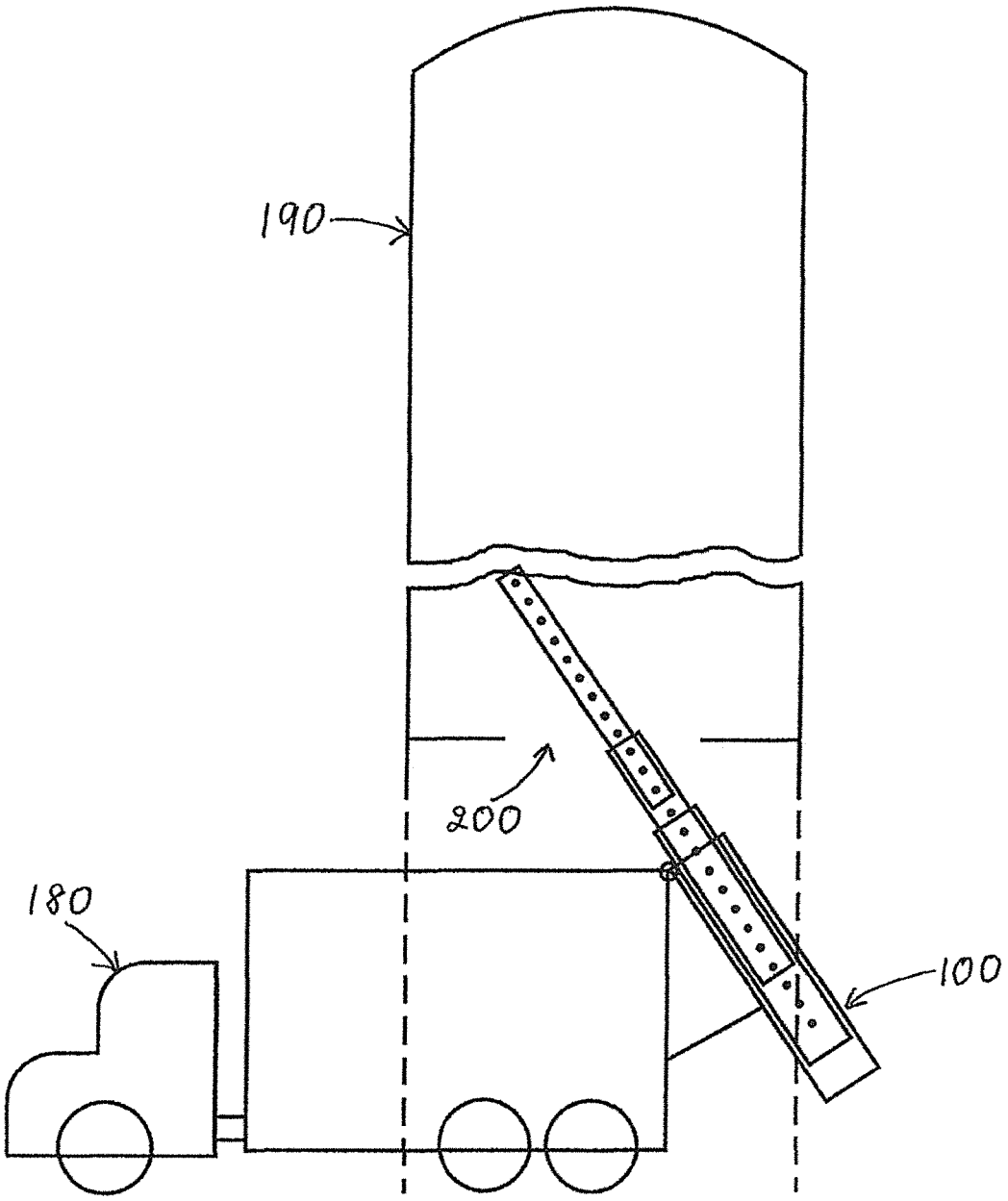
FIG. 4 is a drawing that shows a telescopic ladder being positioned through the bottom opening.

FIG. 3 shows that the ladder 100 may be positioned under the bottom opening 200 of the vertical structure 190. The ladder 100 may be operated by the hydraulic equipment (not shown). FIG. 4 shows the ladder 100 being positioned through the bottom opening 200. The end of the ladder 100 facing towards the bottom opening 200 is termed as top end and the opposing end of the ladder 100 is termed as bottom end.

Figure 5:
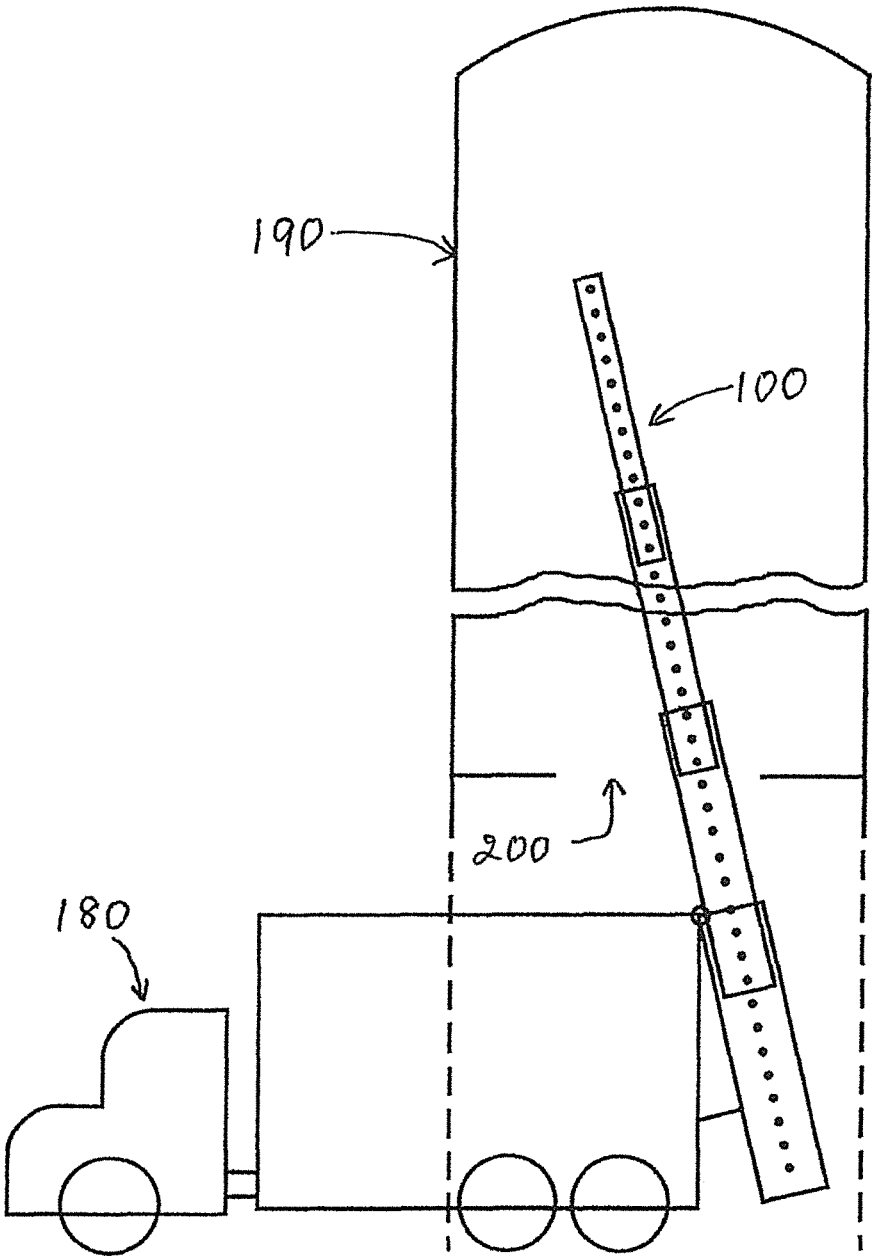
FIG. 5 is a drawing that shows a telescopic ladder being positioned through the bottom opening.
Figure 6:
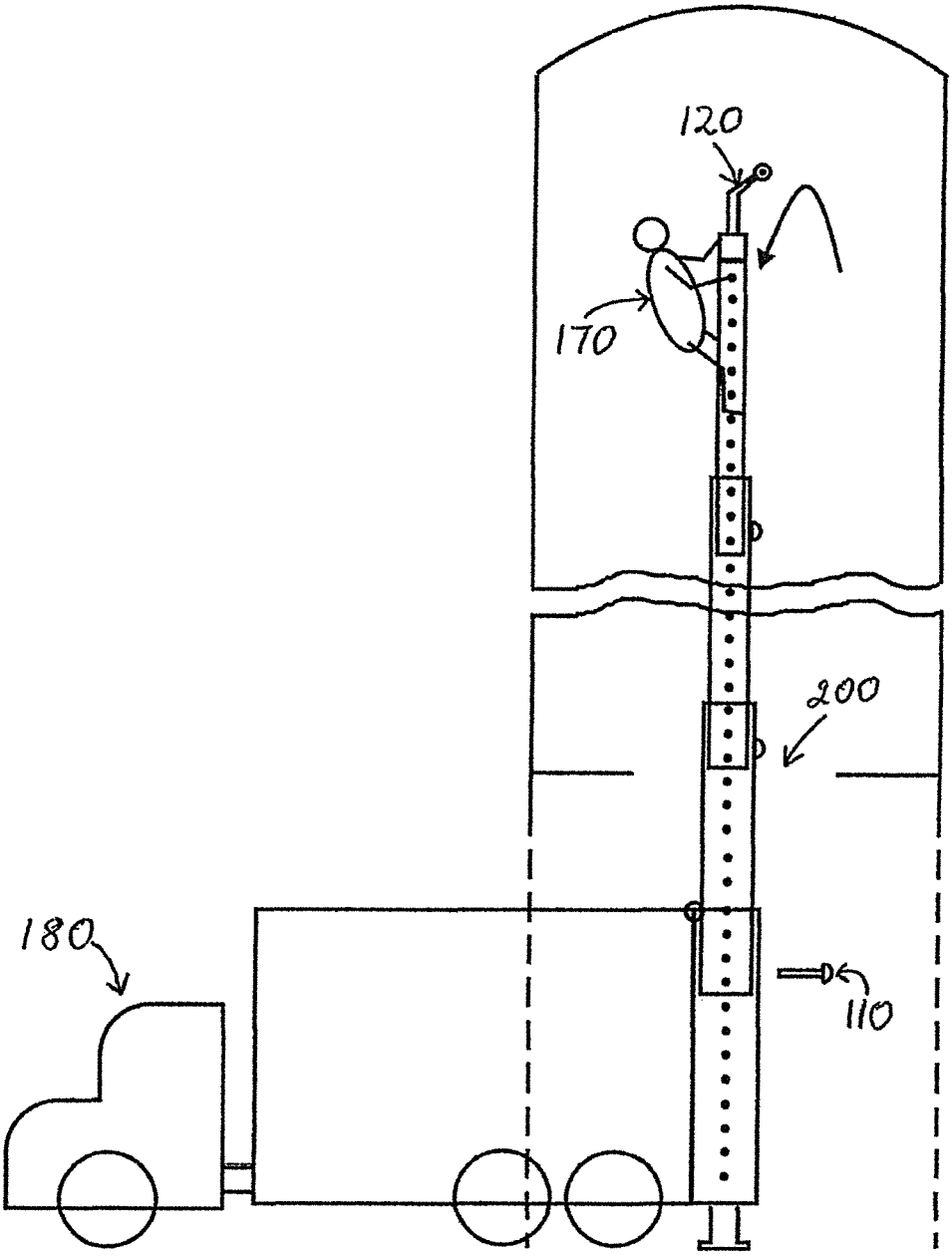
FIG. 6 is a drawing that shows a fully positioned telescopic ladder.

FIG. 5 further shows continued positioning of the ladder 100 inside the vertical structure 190. FIG. 6 shows the fully extended ladder 100 and an individual 170 attaching a knockdown hoist 120 near the top end of the ladder 100. This hoist 120 is adapted to be removably attached to the ladder 100 and enables the individual 170 to bring equipment and supplies from below and vice versa. A motor (not shown) may operate the hoist 120. It also shows a pin 110 that may be inserted to secure the position of the ladder 100.

Figure 7:
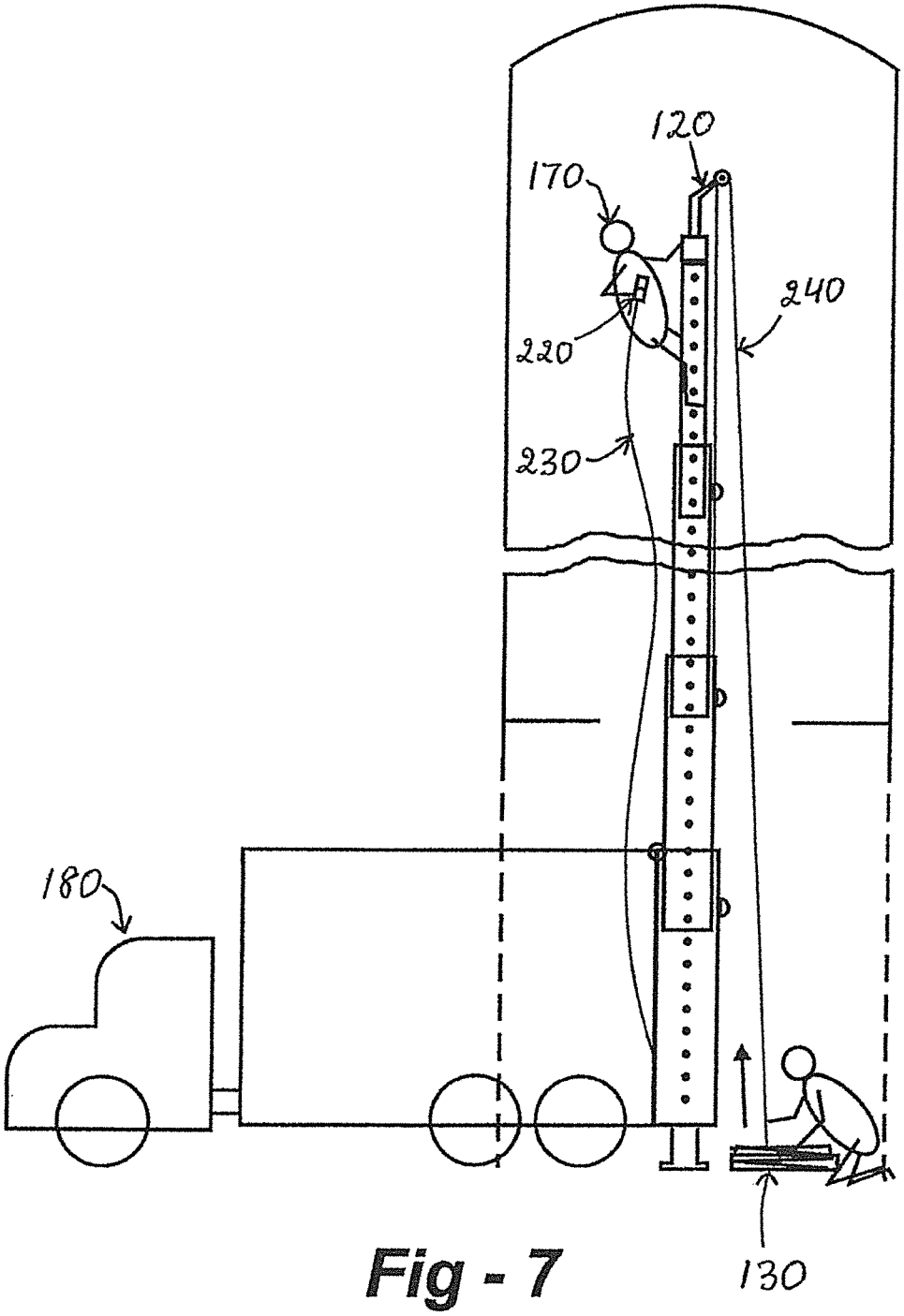
FIG. 7 is a drawing that shows an individual hoisting parts of platform.

FIG. 7 shows an individual 170 hoisting parts of a platform 130 using a control 220. Control 220 may be connected by a wire 230 or by a wireless connection to the hoist 120. An individual can attach equipment and supplies to the hoist cable 240.

Figure 8:
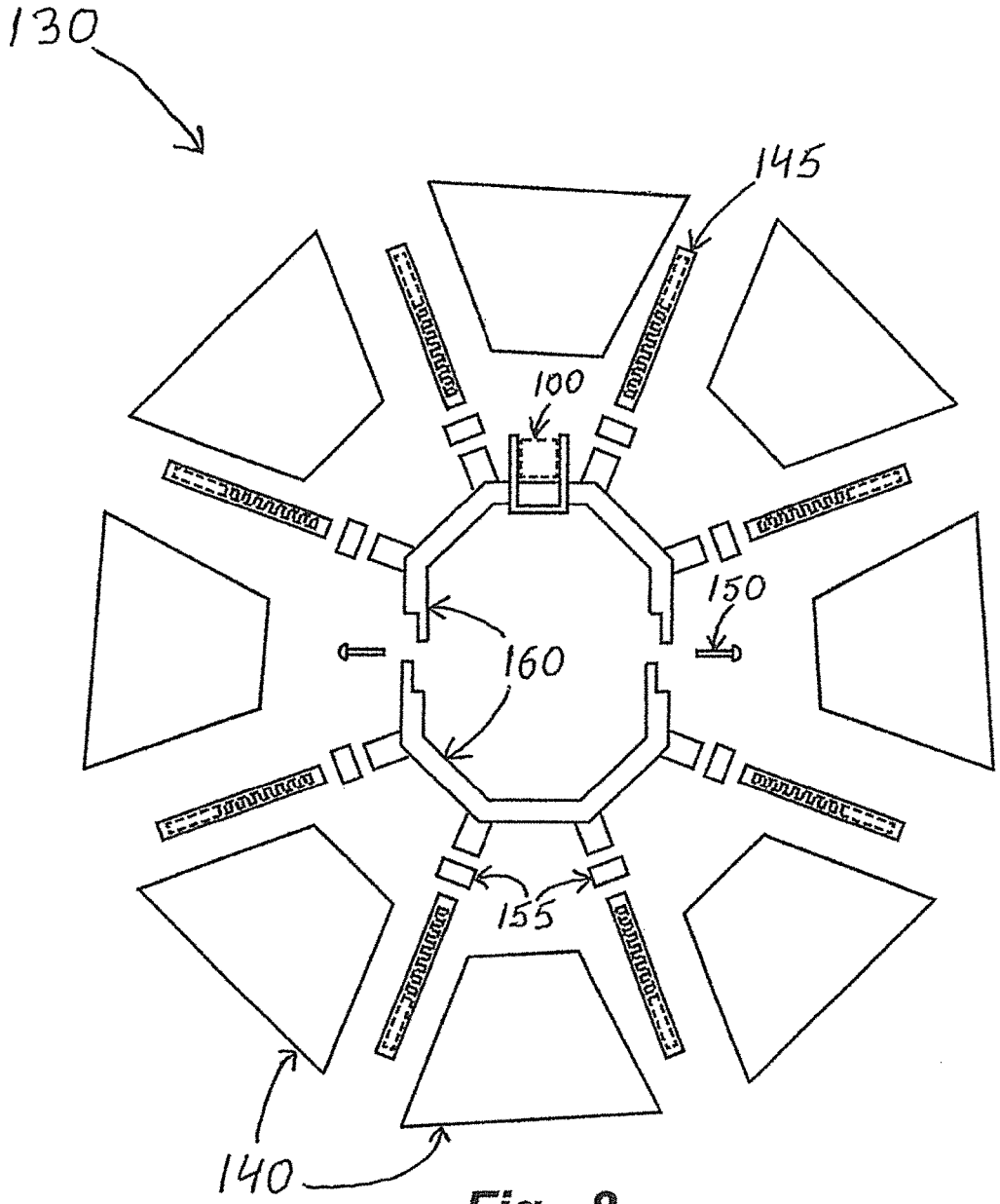
FIG. 8 is a drawing that shows an exploded view of a platform.
Figure 9:
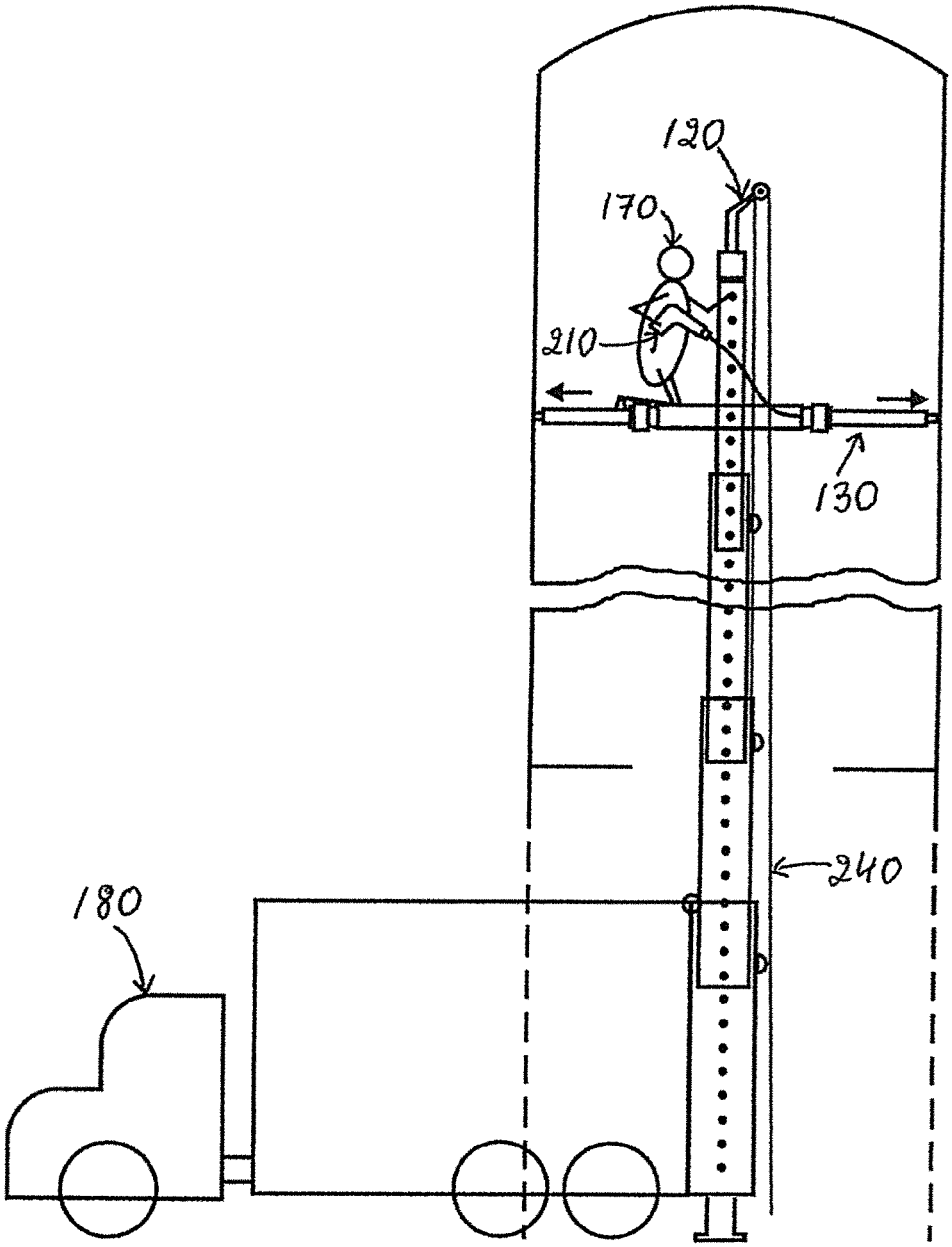
FIG. 9 is a drawing that shows an individual assembling the platform inside the vertical structure.

FIG. 8 shows the exploded view of the platform 130. In accordance with the invention, a platform 130 is assembled above the bottom opening 200 and inside the vertical structure 190. It comprises of frame 160 that may be secured with a locking pin 150. The frame 160 is attached with the ladder 100. The frame 160 may be connected with the rib 145 by using connecting bracket 155. The rib 145 may be screw-driven to extend the rib 145 radially outward. Once the ribs 145 are connected, an individual 170 can attach panels 140 coving the ribs 145. The panels 140 may be made from wooden planks, metal sheets or other material. The platform 130 has a central opening that allows an individual 170 to go up or down the ladder 100 to the platform 130, if needed. FIG. 9 shows an individual 170 using a drill machine 210 on a screw-driven rib 145 that extends radially outward from the platform 130.

Figure 10:
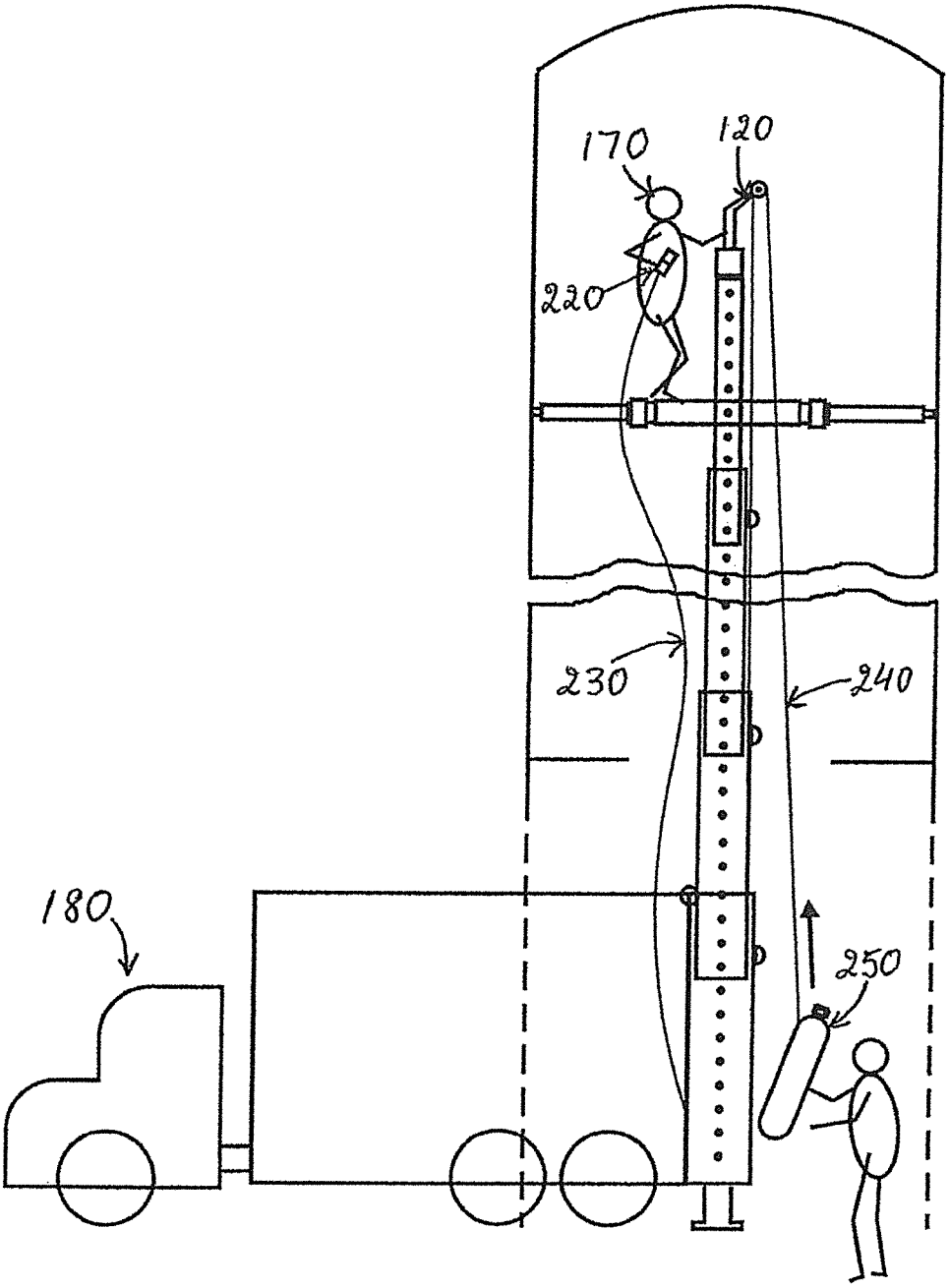
FIG. 10 is a drawing that shows an individual hoisting repair equipment.
Figure 11:
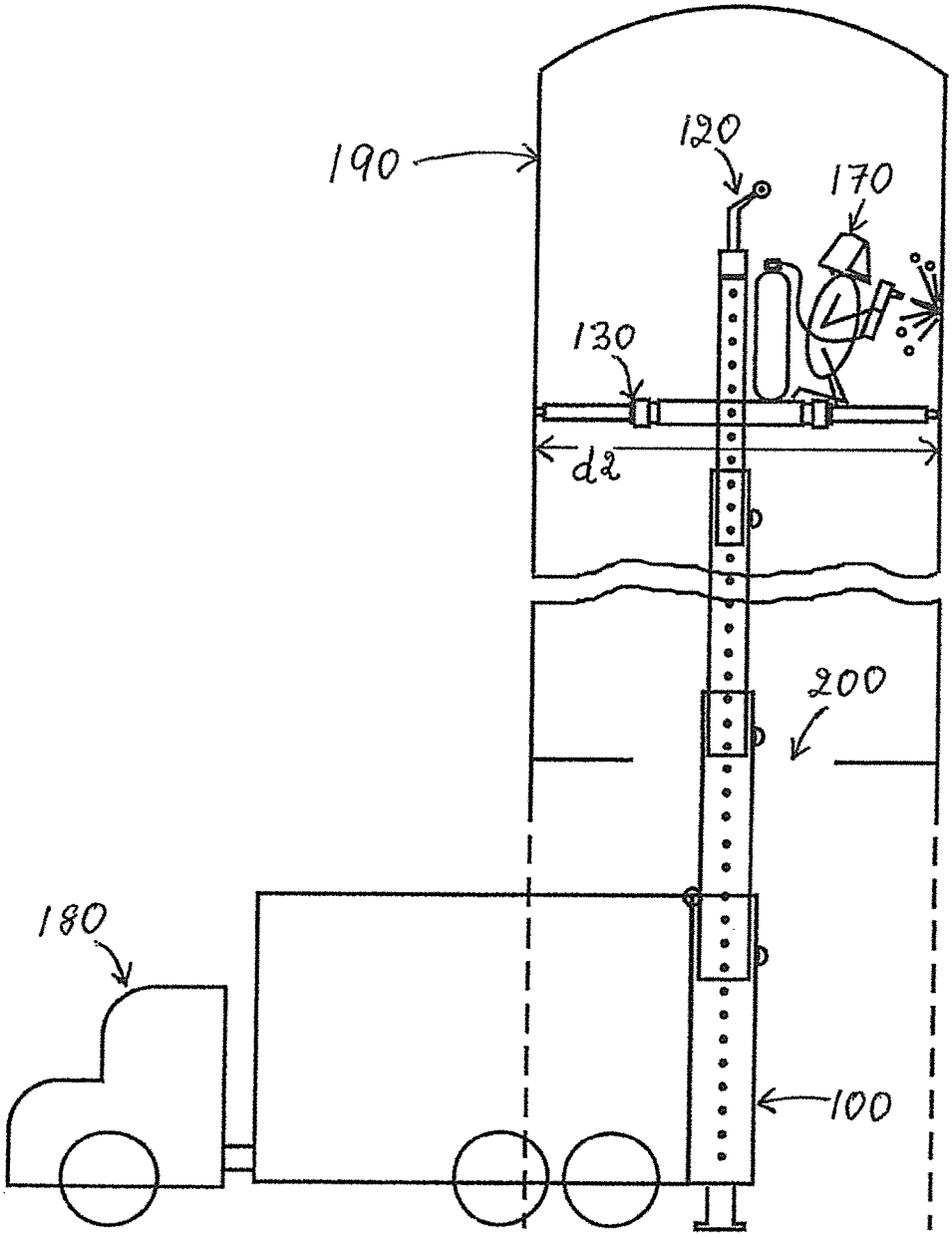
FIG. 11 is a drawing that shows an individual repairing the vertical structure.

FIG. 10 shows an individual 170 using the hoist 120 to bring equipment 250 from below to the platform 130. FIG. 11 shows an individual 170 doing welding near the inner wall of the vertical structure 190. The fully assembled platform 130 has a maximum platform width d2. The maximum platform width d2 is greater than the maximum bottom width d1. Another advantage of this invention is that components are provided in the knockdown form, enabling the platform 130 and hoist 120 to be assembled and disassembled on site.

This invention also discloses a method to maintain a vertical structure. The method may comprise of the following steps: providing the apparatus as discussed above; bringing the ladder 100 into a space under the vertical structure 190; coordinating a position of the ladder 100 relative to a bottom opening 200 of the vertical structure 190; aligning the ladder 100 in an upright position under the bottom opening 200; extending the ladder 100 inside the bottom opening 200; attaching and using a knockdown hoist 120 to bring equipment and supplies to an individual 170 positioned inside the vertical structure 190; hoisting parts of a knockdown platform 130 inside the vertical structure 190 using the hoist 120 and assembling the platform 130 inside the vertical structure 190; and the individual 170 completing steps associated with maintaining the vertical structure 190. The necessary steps may include welding, repairing, cleaning, painting, restoration, refurbishment, remodeling or renovating.

Having described my invention, I claim:

1. An apparatus to maintain a vertical structure having an inner sidewall, the apparatus comprising:

an extendable ladder pivotably coupled to a vehicle and adapted to be extended within the vertical structure;

a knockdown platform adapted to be assembled inside the vertical structure, the platform being removably attachable to the ladder when extended;

the platform when assembled having an upper surface and a central platform opening enabling an individual to climb through the platform opening using the ladder to access the upper surface of the platform;

the platform when assembled further defining an outer perimeter that is spaced-apart from the inner sidewall of the vertical structure;

a hoist positioned above the upper surface of the platform enabling equipment and supplies to be brought up through the platform opening to an individual positioned on the upper surface of the platform;

the knockdown platform further including a plurality of outwardly extending stabilizing ribs, each stabilizing rib terminating in an end adapted to engage with the inner sidewall of the vertical structure;

wherein the outwardly extending stabilizing ribs have screw threads, and wherein the outwardly extending stabilizing ribs are adapted to be rotated with a hand drill so that the ends of the outwardly extending stabilizing ribs extend beyond the outer perimeter of the platform and engage with the inner sidewall of the vertical structure; and wherein the knockdown platform includes a plurality of physically separate panels configured to cover the ribs to form the upper surface of the platform.

2. The apparatus of claim 1, wherein the stabilizing ribs are radially extendable.

3. The apparatus of claim 1, further including a hand held control device connected by a wire or by a wireless connection to raise and lower the hoist.

4. The apparatus of claim 1, wherein the extension of the ladder is hydraulically controlled.

5. The apparatus of claim 1, wherein:

the vertical structure defines a vertical axis; and the upper surface of the assembled platform is substantially perpendicular to the vertical axis of the vertical structure.

6. The apparatus of claim 1, wherein:

the vertical structure has a cylindrical sidewall defining a vertical axis; and the stabilizing ribs extend radially outwardly from the vertical axis to engage with the cylindrical sidewall of the vertical structure.

7. A method to maintain a vertical structure, said method comprising the steps of:

providing the apparatus of claim 1;

bringing the ladder into a space under the vertical structure;

coordinating a position of the ladder relative to the bottom opening of the vertical structure;

aligning the ladder in an upright position under the bottom opening;

extending the ladder inside the bottom opening;

attaching and using the knockdown hoist to bring equipment and supplies to an individual positioned inside the vertical structure;

hoisting parts of the knockdown platform inside the vertical structure using the hoist and assembling the platform inside the vertical structure; and completing steps associated with maintaining the vertical structure.

8. A method according to claim 7, wherein the associated steps include welding, repairing, cleaning, painting, restoration, refurbishment, remodeling, or renovating.

* * * * *